US005865256A

United States Patent [19]

Pounder

[11] Patent Number: 5,865,256

[45] Date of Patent: Feb. 2, 1999

[54] DEFLECTORS FOR PENDENT-TYPE FIRE PROTECTION SPRINKLERS

[75] Inventor: Donald B. Pounder, North Kingstown, R.I.

[73] Assignee: Grinnell Corporation, Cranston, R.I.

[21] Appl. No.: 718,914

[22] Filed: Sep. 25, 1996

[51] Int. Cl.[6] ..... A62C 35/68

[52] U.S. Cl. ..... 169/37; 169/38

[58] Field of Search ..... 169/37, 38, 39, 169/40, 41

[56] References Cited

U.S. PATENT DOCUMENTS

| | | | |
|---|---|---|---|
| 720,013 | 2/1903 | Esty | 169/39 |
| 733,646 | 7/1903 | Hibbard . | |
| 776,614 | 12/1904 | Phelps . | |
| 1,498,139 | 6/1924 | Williams . | |
| 2,076,483 | 4/1937 | Rowley | 169/37 |
| 2,135,138 | 11/1938 | Kendall | 299/18 |
| 2,211,399 | 8/1940 | Winslow | 169/39 |
| 2,389,333 | 11/1945 | Tyden | 169/40 |
| 2,534,066 | 12/1950 | Rowley | 169/38 |
| 3,561,537 | 2/1971 | Bix | 169/38 |
| 3,682,251 | 8/1972 | Livingston | 169/37 |
| 4,580,729 | 4/1986 | Pounder | 239/524 |
| 5,203,416 | 4/1993 | Takeuchi et al. | 169/39 |
| 5,366,022 | 11/1994 | Meyer et al. | 169/37 |
| 5,392,993 | 2/1995 | Fischer | 239/522 |

*Primary Examiner*—Gary C. Hoge
*Attorney, Agent, or Firm*—Fish & Richardson P.C.

[57] ABSTRACT

A pendent-type fire protection sprinkler with a body defining an orifice and outlet for flow of fluid, and a deflector positioned coaxial with the outlet for impingement of fluid flow thereupon. The deflector has one or a combination of features for improved performance. For example, the deflector may have a frusto-conically shaped recess within a central area facing the sprinkler outlet, the recess defined by a surface slanted at a predetermined acute angle to the horizontal, with a plurality of holes or slots defined by the slanted surface, the recess being surrounded by an essentially flat outer area perpendicular to the sprinkler outlet axis. The deflector may have a bump, or other irregularity, on the sprinkler deflector inside surface opposed to the sprinkler outlet on each of the opposite tines in a plane perpendicular to a plane of the sprinkler frame arms. The deflector may have openings at about 45° to the plane of the frame arms, the openings shaped with the width of each opening gradually decreasing towards the deflector periphery.

37 Claims, 3 Drawing Sheets

DEFLECTORS FOR PENDENT-TYPE FIRE PROTECTION SPRINKLERS

The invention relates to deflectors for fire protection sprinklers.

BACKGROUND OF THE INVENTION

A typical automatic fire sprinkler has a body with an outlet that is normally closed by a plug, the plug being held in place by a heat-activated trigger mechanism, and an orifice normally just upstream of the outlet. Automatic sprinklers of the pendent type also have a substantially horizontal water distribution deflector facing the outlet. When a sufficiently elevated temperature is sensed, a thermally responsive element normally retaining the plug in a closed position releases the plug, allowing a vertically directed stream of water (downward for pendent sprinklers and upward for upright sprinklers) to rush from the outlet orifice towards the deflector. The water, impacting on the deflector, is diverted generally radially downward and outward, breaking into a spray pattern, the shape of which is, in large part, a function of the deflector configuration, projecting over the intended area of coverage, i.e. "the protected area".

Within the past three years, the range of available fire protection products for automatic fire sprinkler systems has expanded to include ceiling sprinklers designed to cover larger or "extended coverage" areas, when the occupancy being protected falls into the Ordinary Hazard category, as defined by NFPA 13, *Standard for the Installation of Sprinkler Systems*. These sprinklers are referred to as extended coverage/ordinary hazard (ECOH) sprinklers. In order to be acceptable for installation under an installation standard like NFPA 13, an automatic fire sprinkler must appear in a list published by an organization acceptable to the authority having jurisdiction, and meet any additional requirements specified in the installation standard. organizations listing ECOH sprinklers include, e.g., Underwriters Laboratories Inc. (ULI) and Factory Mutual Research Corporation (FMRC). These, and other, similar, organizations evaluate the performance of fire protection products, like ECOH sprinklers, in accordance with established standards or guidelines, to certify that the listed fire protection products will satisfactorily perform their intended function when installed in accordance with the requirements of their listing, the manufacturer's installation instructions, and the installation standards of the authority having jurisdiction.

The standards or guidelines for evaluating ECOH sprinklers include established requirements for the minimum amount of water which must be collected during testing per unit time and in specified areas (i.e., density) under and between the sprinklers when discharging water under specified flowing (residual pressure) conditions. The testing may be conducted both with and without the presence of fire.

ECOH pendent sprinklers developed thus far have utilized a series of relatively narrow slots located around the periphery of the deflector, in order to produce a spray pattern in which most of the water is directed radially outward to the outer portions of the larger (extended) area to be protected. This type of design, however, tends to yield a light area of spray with water droplets having low downward momentum within the inner portion of the pattern and beneath the sprinkler. If a fire starts beneath the sprinkler, the upward draft of the fire plume can overcome the downward momentum of water droplets being discharged beneath the sprinkler, if it is excessively light, thereby uplifting the spray pattern and resulting in a nil quantity of water penetrating to the seat of the fire to enable extinguishment.

SUMMARY OF THE INVENTION

According to one aspect of the invention, a pendent-type fire protection sprinkler comprises a body defining an orifice and outlet for flow of fluid from a source, and a deflector disposed generally coaxial with the outlet and positioned for impingement of the flow of fluid thereupon. The deflector defines an inner surface opposed to water flow from the outlet and an opposite outer surface. The inner surface defines a recess within a central area facing the sprinkler outlet, the recess comprising a slanted surface disposed at a predetermined acute angle to the horizontal, the slanted surface defining a plurality of through holes from the inner surface of the deflector to the opposite outer surface, and an essentially flat outer area surrounding the recess and disposed generally perpendicular to the axis of the sprinkler outlet, the recess being spaced further from the outlet relative to the essentially flat outer area.

Preferred embodiments of this aspect of the invention may include one or more of the following additional features. The recess within the central area facing the sprinkler outlet has a frusto-conical shape. The predetermined acute angle of the slanted surface is in the range of about 13° to 25°, preferably about 16° to 22°, and more preferably about 19°. The plurality of through holes defined by the slanted surface comprises at least one through hole having an axis directed outwardly, away from the axis, in the direction of water flow from the outlet. The plurality of through holes defined by the slanted surface comprises at least four, and more preferably at least eight, through holes. The plurality of through holes defined by the slanted surface are generally equally spaced about the axis. The plurality of through holes defined by the slanted surface has a first dimension, in a radial direction, and a second dimension, in a transverse direction, the first dimension being greater than the second dimension. Preferably, the first dimension is about 0.070 inch and the second dimension is about 0.050 inch. The pendent-type fire protection sprinkler further comprises a pair of frame arms extending from the body and disposed generally in a first plane including the axis, with the deflector mounted thereupon, and the deflector further comprises a plurality of tines extending about its deflector periphery and defining a plurality of openings therebetween, a pair of opposite tines disposed in a second plane perpendicular to the first plane each comprising an irregularity constructed to create a notch-like opening in the upper part of the spray pattern to prevent cold soldering of adjacent sprinklers. Preferably, the irregularity comprises an upraised bump extending from the inner surface of the deflector towards the outlet, each bump having an outside diameter of about 0.040 inch and a height of about 0.025 inch. The plurality of openings comprises tapering openings disposed at about 45° to the first plane, the tapering openings having a first base width at an inner region and a second outer width at the deflector periphery, the first width being relatively greater than the second width, and the inner region being relatively closer to the axis than the deflector periphery, whereby the width of each of the tapering openings gradually decreases as the radial distance from the axis increases, out to the deflector periphery. Preferably, the first width dimension is in the range of about 0.080 inch to 0.110 inch and the second width dimension is in the range of about 0.050 inch to 0.090 inch. The pendent-type fire protection sprinkler further comprises a pair of frame arms extending from the body and disposed generally in a first plane including the axis, with the deflector mounted thereupon, the deflector comprising a plurality of tines extending about its deflector periphery and defining a plurality of openings therebetween, the plurality of openings comprising tapering openings disposed at about 45° to the first plane, the tapering openings having a first base width at an inner region and a second outer width at the deflector periphery, the first width being relatively greater than the second width, and the inner region being relatively closer to the axis than the deflector periphery, whereby the width of each of the tapering openings gradually decreases as the radial distance from the axis increases, out to the deflector periphery. Preferably, the first width dimension is in the range of about 0.080 inch to 0.110 inch and the second width dimension is in the range of about 0.050 inch to 0.090 inch.

According to another aspect of the invention, a pendent-type fire protection sprinkler comprises a body defining an orifice and outlet for flow of fluid from a source, a deflector disposed generally coaxial with the outlet and positioned for impingement of the flow of fluid thereupon, the deflector defining an inner surface opposed to water flow from the outlet and an opposite outer surface, and a pair of frame arms extending from the body and disposed generally in a first plane including the axis, with the deflector mounted thereupon. The deflector comprises a plurality of tines extending about its deflector periphery and defining a plurality of openings therebetween, a pair of opposite tines disposed in a second plane perpendicular to the first plane each defining an irregularity constructed to create a notch-like opening in the upper part of the spray pattern to prevent cold soldering of adjacent sprinklers.

Preferred embodiments of this aspect of the invention may include one or more of the following additional features. The irregularity comprises an upraised bump extending from the inner surface of the deflector towards the outlet, each bump having an outside diameter of about 0.040 inch and a height of about 0.025 inch. The inner surface of the deflector defines a recess within a central area facing the sprinkler outlet, the recess comprising a slanted surface disposed at a predetermined acute angle to the horizontal, the slanted surface defining a plurality of through holes from the inner surface of the deflector to the opposite outer surface, and an outer area surrounding the recess, the recess being spaced further from the outlet relative to the outer area. The outer area is essentially flat and disposed generally perpendicular to the axis of the sprinkler outlet. The recess within the central area facing the sprinkler outlet has a frusto-conical shape.

According to another aspect of the invention, a pendent-type fire protection sprinkler comprises a body defining an orifice and outlet for flow of fluid from a source, a deflector disposed generally coaxial with the outlet and positioned for impingement of the flow of fluid thereupon, the deflector defining an inner surface opposed to water flow from the outlet and an opposite outer surface, and a pair of frame arms extending from the body and disposed generally in a first plane including the axis, with the deflector mounted thereupon. The deflector comprises a plurality of tines extending about its deflector periphery and defining a plurality of openings therebetween, the plurality of openings comprising tapering openings disposed at about 45° to the first plane, the tapering openings having a first base width at an inner region and a second outer width at the deflector periphery, the first width being relatively greater than the second width, and the inner region being relatively closer to the axis than the deflector periphery, whereby the width of each of the tapering openings gradually decreases as the radial distance from the axis increases, out to the deflector periphery.

Preferred embodiments of this aspect of the invention may include one or more of the following additional features. The first width dimension is in the range of about 0.080 inch to 0.110 inch and the second width dimension is in the range of about 0.050 inch to 0.090 inch. A pair of the tines disposed in opposite positions in a second plane perpendicular to the first plane each defines an irregularity constructed to create a notch-like opening in the upper part of the spray pattern to prevent cold soldering of adjacent sprinklers. The irregularity comprises an upraised bump extending from the inner surface of the deflector towards the outlet, each bump having an outside diameter of about 0.040 inch and a height of about 0.025 inch. The inner surface of the deflector defines a recess within a central area facing the sprinkler outlet, the recess comprising a slanted surface disposed at a predetermined acute angle to the horizontal, the slanted surface defining a plurality of through holes from the inner surface of the deflector to the opposite outer surface, and an outer area surrounding the recess, the recess being spaced further from the outlet relative to the outer area. The outer area is essentially flat and disposed generally perpendicular to the axis of the sprinkler outlet. The recess within the central area facing the sprinkler outlet has a frusto-conical shape.

Preferred embodiments of each aspect of the invention may include one or more of the following additional features. The pendent-type fire protection sprinkler may have a K-factor of at least 3.5, or at least 5.0, or at least 7.0, or at least 10.5, or at least 13.0.

In addition to meeting minimum water density requirements, as described above, it is advantageous for fire sprinklers to spray as uniform a distribution of water as possible, whether operating individually or in groups, in order to provide an acceptable level of fire protection performance, no matter where within the protected area a fire starts. This is particularly difficult to achieve for ECOH sprinklers designed for use over a range of coverage areas from 14 ft.×14 ft. to 20 ft.×20 ft.

The shape of the water spray pattern directly affects circulation of air in the vicinity of a discharging sprinkler. By shaping the deflector to direct water primarily radially outward in an umbrella-shaped pattern, i.e., initially generally parallel to the ceiling under which the sprinkler is located, the thrust of the water jet is directed so that air along the ceiling is entrained by the water flow and swept outward, away from the sprinkler. At the edges of the spray pattern, the air descends and circulates inward along the floor, toward the center of the spray pattern, where it billows up, similar to a rising cumulus cloud.

Alternatively, by shaping the deflector so that water is directed primarily downward, in a more conical pattern, the thrust of the water jet is such that air is entrained by the downwardly directed water and draws air in along the ceiling toward the sprinkler. This sets up a different overall circulation pattern.

Depending on the intended fire protection application of the sprinkler, either spray and circulation pattern, or even some superimposed combination of patterns, may be desired, and the spray pattern of the sprinkler can be structured accordingly.

Parameters which establish the spray pattern and hence the circulation pattern of a pendent sprinkler include: the form or shape of the deflector; the outside dimensions of the deflector; the shape and arrangement of spaced-apart tines located around the periphery of the deflector; as well as the shape, arrangement and size of through holes defined by the deflector body. The tines of a pendent deflector tend to deflect water outwardly to fill in the area generally away from the sprinkler. The angle, size and shape of the tines affect the pattern and quantity of outwardly deflected water. Water passing diagonally downward through spaces or openings between the tines forms the generally inner portion of the spray pattern, as well as the pattern beneath the sprinkler, with the angle, size and shape of the openings between the tines affecting the pattern of the spray and the quantity, or density, of the water. The outside dimensions of the deflector affect the area of the spray pattern and, therefore, the area to be protected by the sprinkler. Generally speaking, increasing the outer dimensions of the deflector causes water to be distributed further away from the sprinkler, with an associated reduction in the amount of water distributed around the inner portion of the spray pattern. The size, arrangement and shape of the holes defined in the interior area of the deflector affect the amount of water discharged in the area generally beneath the sprinkler, which is in addition to that passing through the inner portion of the openings between the tines. Holes located within the outer area of the deflector affect the amount of water added to either the inner portion of the spray pattern or to the area generally beneath the sprinkler, all depending on the shape of the deflector in the area of the holes.

One purpose of this invention is to provide a readily controllable increase in the amount of water distributed beneath and within the inner portion of the spray pattern of an ECOH pendent type sprinkler, in a specified manner, without enlarging the radially inner area of the openings between the tines located around the periphery of the deflector and, therefore, undesirably drawing excess water inward from the outer portion to the inner portion of the spray pattern.

Variabilities of building construction make it sometimes necessary to space sprinklers much closer together than their maximum permitted spacings in order to provide the required degree of protection around obstructions such as columns or partitions. However, as sprinklers are brought closer together, there is an increased tendency for the spray from an operating sprinkler to impinge on an adjacent sprinkler which has not yet operated; thereby wetting the thermally responsive element of the adjacent sprinkler and preventing its proper or timely operation. If this condition known as "cold soldering" occurs, it can result in the fire progressing past the wetted element sprinkler, thereby increasing the damage caused by the fire. Consequently, organizations which list sprinklers include a cold soldering test in their product evaluations.

Sprinklers listed for use with a maximum standard coverage area of 130 sq. ft. for ordinary hazard classified occupancies, as defined by NFPA 13, are required to be able to be located as close as 6 ft. apart without cold soldering. The maximum sprinkler spacing for the 130 sq. ft. coverage area is 10 ft.×13 ft.

In the case of an extended coverage sprinkler such as an ECOH pendent type sprinkler, it is difficult to design a unit which will not result in cold soldering at a spacing as low as 9 ft., yet provide an umbrella-shaped water spray pattern that is necessarily high enough and wide enough to allow use of the sprinklers at a maximum spacing of 20 ft.×20 ft. (i.e., coverage area of 400 sq. ft.).

An additional purpose of this invention is to provide a pendent type ECOH sprinkler deflector design capable of providing a 20 ft.×20 ft. maximum spacing coverage capability in combination with a minimum spacing capability of 9 ft., without sacrifice of desired uniformity of the spray pattern over the entire protected area.

Another concern in development of automatic fire sprinklers is providing the water distribution performance necessary for that portion of the protected area furthest from any sprinkler. As specified in NFPA 13, sprinklers having frame arms, which is typical of the pendent type, are usually installed with the plane of the sprinkler frame arms generally parallel to one wall of the space in which they are installed.

If the sprinklers are installed in a square pattern (which generally minimizes the number of sprinklers which must be installed to protect a space), the point centered between four sprinklers (i.e., 45° from the plane of the frame arms) is furthest away from any of the sprinklers. The center point of this geometry is about 1.41 times one-half the sprinkler spacing away from any of the sprinklers. This is the worst case distance in terms of the "throw" necessary to ensure that sufficient water is distributed over the entire area to be protected without spraying water too far into other areas.

In this regard, it is also a feature of this invention to provide increased water collection, i.e. density, in the central portion of the protected area furthest from four sprinklers, such as the ECOH pendent-type installed in a square array, without sacrifice of the desired uniformity of the spray pattern over the entire protected area.

Extended coverage/ordinary hazard rated sprinklers are required to provide the same rates of water collection per unit area (i.e., density, in terms of gpm/sq. ft.) as standard coverage/ordinary hazard sprinklers, over the increased coverage area. NFPA 13 presently requires that sprinklers provide an average density of either 0.15 gpm/ft.$^2$ or 0.20 gpm/ft.$^2$ over the coverage area depending on whether the commodity being protected is classified as Ordinary Hazard Group 1 or Group 2, respectively, assuming a sprinkler operation design area of 1500 sq. ft. Thus, to cover the maximum allowable standard coverage area of 130 ft.$^2$ for Ordinary Hazard Group 2, a minimum flow of 26 gpm per sprinkler over the sprinkler operation design area is required. However, to cover the maximum allowable extended coverage area of 400 ft.$^2$ per NFPA 13, 80 gpm is required. It is a natural and well understood principle that the much higher flow requirements for ECOH sprinklers make it necessary to utilize a sprinkler with a relatively larger waterway as compared to that commonly used for standard coverage/ordinary hazard applications.

The flow "Q" from a sprinkler expressed in U.S. gallons per minute (gpm) is determined by the formula:

$$Q=K(p)^{1/2}$$

where "K" represents the nominal sprinkler discharge coefficient, normally referred to as K-factor, and "p" represents the residual (flowing) pressure at the inlet to the sprinkler in pounds per square inch (psi). In standard coverage/ordinary hazard applications, the most commonly used sprinklers have K-factors of about 5.6 (standard orifice) or 8.0 (large orifice). However, in extended coverage/ordinary hazard applications, sprinklers having K-factors of about 11.2 (extra large orifice) or 14.0 (very extra large orifice) are commonly used.

The use of the larger K-factor sprinklers for ECOH applications reduces the required residual (flowing) pressure at the sprinkler inlet. This is advantageous since generation of the higher pressure will require more power. In addition to lowering the minimum required residual (flowing) pressure over the sprinkler operation design area, the use of extra large and very extra large orifice sprinklers provides another well understood advantage. That is, as the residual (flowing) pressure is lowered, there is an increase in size of the water droplets created by the water stream emitted from the sprinkler orifice striking the sprinkler deflector and the portions of the sprinkler frame arms falling within the water stream. These larger water droplets have a higher momentum which assists in penetration of the upward draft created by a fire. In addition, the higher momentum water droplets can be deflected further from the sprinkler, as desired for extended coverage performance capability.

It is noted that using ECOH sprinklers with higher K-factors is not necessarily an advantage in all circumstances. For example, if the coverage area is 14 ft. ×14 ft. and the commodity is rated as Ordinary Hazard Group 1, a minimum flow of only 29.4 gpm per sprinkler is required. This means the minimum required residual (flowing) pressure at the inlet of a 14.5 K-factor sprinkler would be only 4.1 psi. Use of such a low pressure could be of concern with respect to ensuring that the operating parts of the sprinkler are properly ejected when the thermally responsive element releases. This concern has been recognized by the National Fire Protection Association, and it is expected that the 1996 edition of NFPA 13 will be revised to require design of all sprinkler systems to operate any sprinkler at a minimum residual (flowing) pressure of 7 psi.

The features of the present invention are currently used in 11.4 and 14.5 K-factor pendent type ECOH sprinklers. However, the advantages provided are not limited to the higher K-factor sprinklers. For example, they could be used with nominally 5.6 and/or 8.0 K-factor sprinklers These and other features and advantages of the invention will be apparent from the following description of a presently preferred embodiment, and from the claims.

DESCRIPTION OF THE PREFERRED EMBODIMENTS

Figure 1:
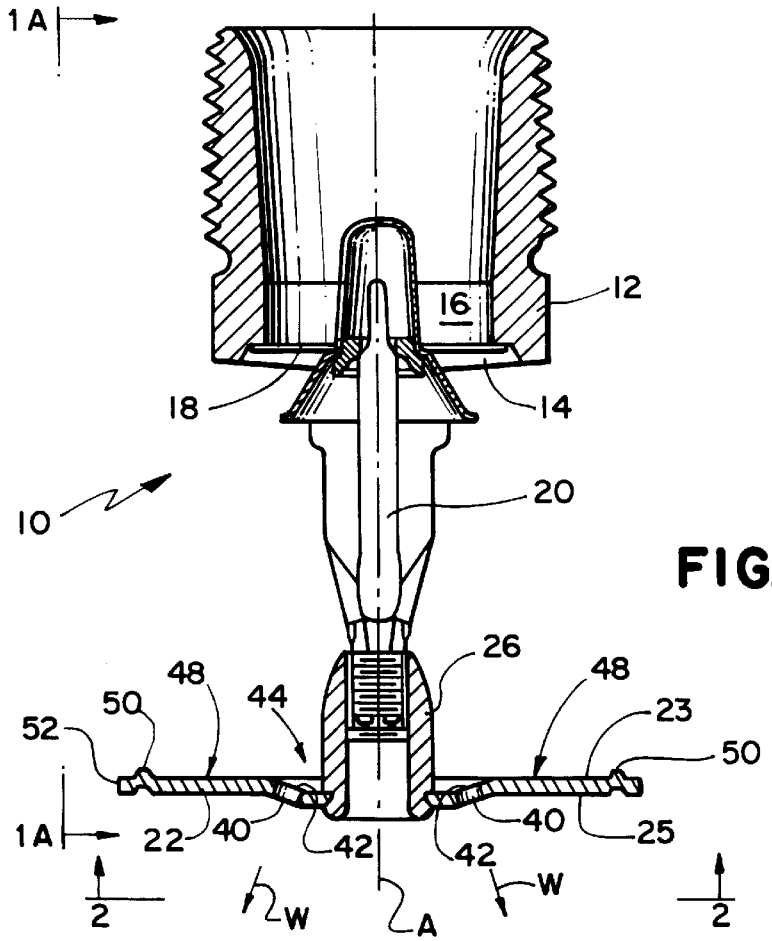
FIG. 1 is a side elevation view, taken in section, of a pendent-type fire protection sprinkler with a deflector of the invention.
Figure 2:
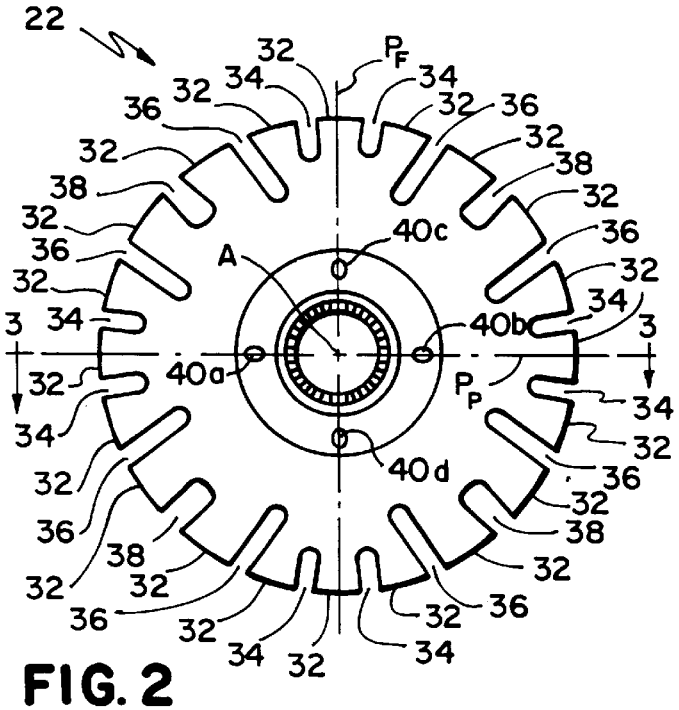
FIG. 2 is a bottom plan view of the deflector of the invention for a pendent-type fire protection sprinkler, taken along the line 2—2 of FIG. 1.
Figure 1A:
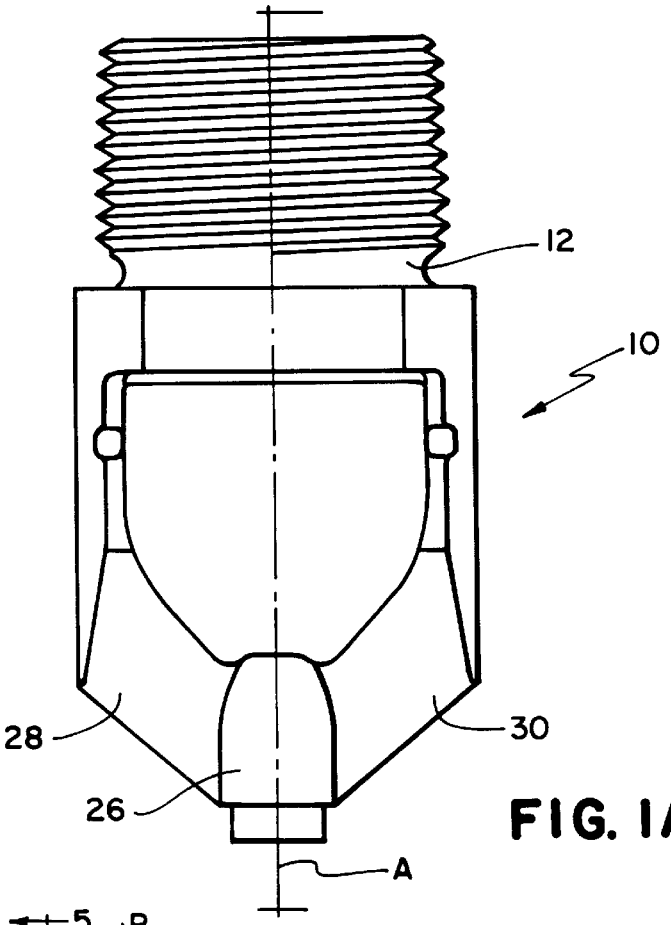
FIG. 1A is a side section view of the body of the pendent-type fire protection sprinkler taken along the line 1A—1A of FIG. 1, with the deflector removed.

Referring to FIGS. 1, 1A, and 2, this invention concerns a fire protection sprinkler device 10 of the pendent type including a body 12 having an outlet 14 and an orifice 16, with a releasable plug 18 normally closing the outlet 14 and securing it in a sealed condition, a thermally responsive element 20 normally retaining the plug in closed position, and a water distribution deflector 22 facing the orifice. The orifice 16 that determines the K-factor of the sprinkler is normally located just upstream of the outlet 14. A pendent-type sprinkler 10 is one installed in such a way that a water stream discharged from the outlet 14, following release of the thermally responsive element 20, is directed downwards against a distribution plate normally referred to as a deflector 22, typically mounted to sprinkler mounting boss 26, supported by frame arms 28, 30.

Figure 3:
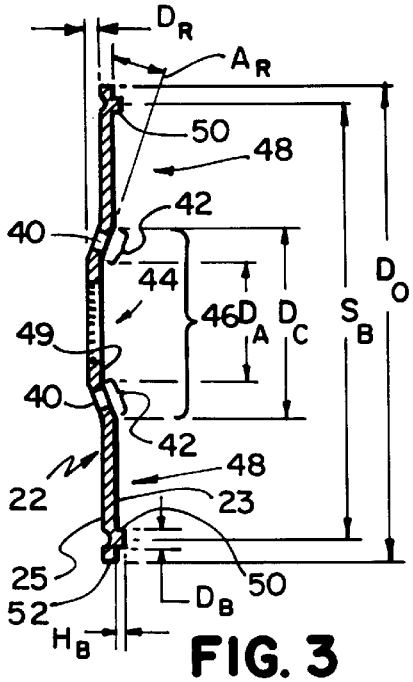
FIG. 3 is a side section view of the deflector, taken along the line 3—3 of FIG. 2.

A deflector 22 of the invention for use with 11.4 and 14.5 K-factor pendent-type fire protection sprinklers, e.g., of the type to be sold by Grinnell Corporation, of Exeter, N.H., under the Model F895 ECOH designation, is shown in FIGS. 2 and 3. The deflector 22 is formed from a blank 24, shown in FIGS. 4 and 5.

Referring now also to FIG. 3, the deflector 22 has an inner surface 23 opposed to flow of water from the outlet 14 and an opposite, outer surface 25. The pendent deflector has an outside diameter, $D_O$, e.g., for an 11.4 K-factor sprinkler, about 1.49 inches, and, for a 14.5 K-factor sprinkler deflector, about 1.59 inches. The deflector has twenty tines 32 spaced around the periphery, with openings or spaces therebetween. A first set of radial openings 34, e.g. eight in number, extend outwardly from an axis, A, through the sprinkler outlet. Openings 34 have a width, $W_{O1}$, e.g. nominally 0.062 inch, and an overall length, $L_{O1}$, e.g. about 0.145 inch. A second set of openings 36, e.g. also eight in number, are specifically positioned in a non-radial manner to achieve the desired distribution of water spray. Pairs of these non-radial openings 36 are equally spaced about the centerlines, $C_1$, $C_2$, with an included angle, $A_{O2}$, between the spaced-apart openings 36, e.g. about 72°. Openings 36 have a width, $W_{O2}$, e.g. also nominally 0.062 inch, and an overall length, $L_{O2}$, e.g. about 0.285 inch. The remaining openings 38, e.g. four in number, located at about 45° to the plane, $P_F$, of the frame arms 28, 30, will be described in more detail below.

The shape of the deflector 22 of the invention creates a substantially more uniform and optimized spray pattern for the protection of large (extended coverage) areas.

Figure 4:
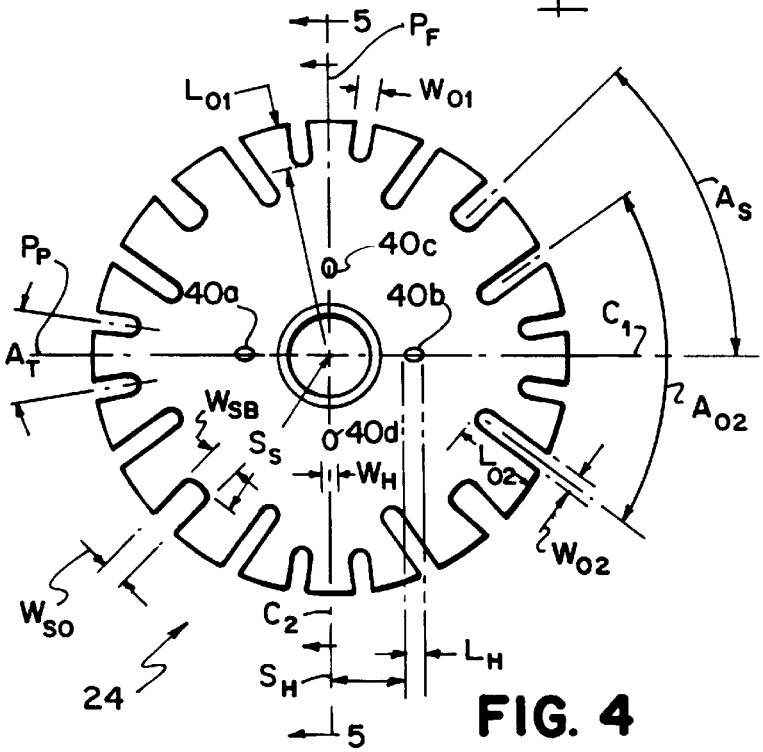
FIG. 4 is a bottom plan view of a blank for forming a deflector of the invention, prior to bending; and, FIG. 5 is a side section view of the blank, taken along the line 5—5 of FIG. 4.
Figure 5:
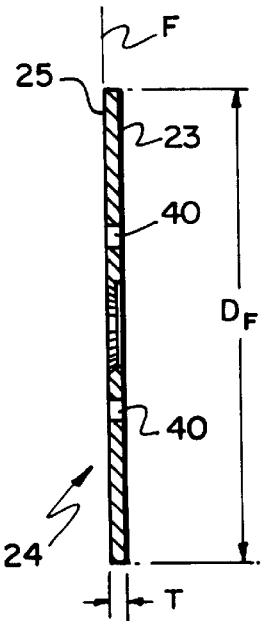
Figure 6:
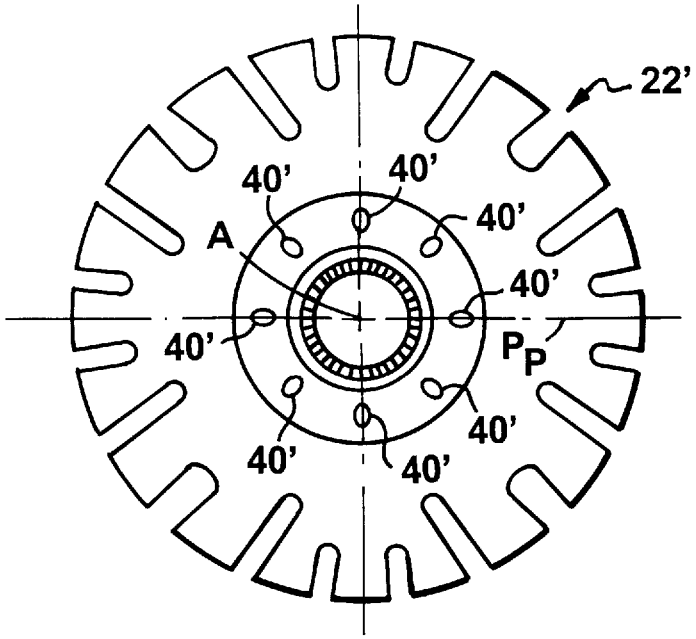
FIG. 6 is a bottom plan view of another deflector of the invention for a pendent-type fire protection sprinkler.

In particular, a first improvement is provided by use of equally spaced, elongated holes 40 located on the slanted surface portion 42 of a frusto-conically shaped recess 44 located within the central area 46 of the deflector 22 and facing the sprinkler outlet 14. (By way of example, only the minimum number of four holes are shown; a minimum of eight holes would be more typical.) The recess 44 is surrounded by an essentially flat outer area 48 that is generally perpendicular to the axis, A, of the sprinkler outlet 14, the recess 44 being spaced relatively further from the outlet 14 than the flat outer area 48, and the flat base area 49 portion of the frusto-conically shaped recess being spaced furthest from the outlet 14. The minimum array of elongated holes 44 preferably includes two holes 40*a*, 40*b* in a plane, $P_P$, generally perpendicular to the plane, $P_F$, of the sprinkler frame arms 28, 30, and two additional holes 40*c*, 40*d* generally in line with the plane, $P_F$, of the sprinkler frame arms 28, 30. The recess has a depth, DR, *e.g. nominally* 0.045 inch, and the slanted surface portion 42 is angled away from the horizontal and towards the sprinkler outlet 14 at an angle, $A_R$, e.g. about 13° to 25°, preferably about 16° to 22°, and optimally about 19°. The axes of the elongated holes 40, as formed in the flat blank 24, are perpendicular to the plane, F, of the deflector blank 24 (FIGS. 4 and 5). After the deflector 22 is formed (FIGS. 2 and 3), the holes 40 are located on the slanted surface 42 and thus are angled generally towards the sprinkler outlet 14. As a result, water discharged downward through holes 40 is diverted radially outward (arrows W, FIG. 1) from the axis, A, of the sprinkler outlet, thus providing a controlled increase in the amount of water distributed within the inner portion of the spray pattern. If elongated holes 40 were simply located on a flat deflector, the water discharged through the holes would be sprayed directly downward, likely to converge in an extremely small area, e.g., less than 1 ft. in diameter, centered around the axis, A, of the sprinkler outlet 14. In the preferred embodiment of this invention, the elongated holes 40 have radiused ends aligned generally with radii of the deflector axis, A, e.g., referring to FIG. 2, the holes 40 have radiused ends aligned in the direction of the plane Pp (holes 40*a*, 40*b*) or in the direction of the plane $P_F$ (holes 40*c*, 40*d*). The holes 40 have a width, $W_H$, e.g. about 0.050 inch, and a length, $L_H$, about 0.070 inch, when the deflector is in the flat blank state (FIGS. 4 and 5), prior to forming the recess 44. As mentioned above, at a minimum, the ECOH pendent-type deflectors of the invention have four elongated holes and, more preferably, as seen in deflector 22' (FIG. 6) have a minimum of eight elongated holes 40' equally spaced around the axis,A, of the sprinkler outlet 14.

Examples of the additional water provided to the inner portion of the spray patterns of 11.4 and 14.5 K-factor ECOH pendent-type sprinklers is provided by the following comparison data for water collections in an "under one" Factory Mutual water distribution test. This test data is for a deflector-to-top-of-pan distance of 8 ft., 8 in. (104 inches) and a deflector-to-ceiling distance of 1 ft., 4 in. (16 inches). Water flow was 38 gpm for the 11.4 K-factor sprinkler and 60 gpm for the 14.5 K-factor sprinkler. The Series 1 results are for flat deflectors without holes within the central area. The Series 2 results are for deflectors 22 of the invention with four equally spaced elongated holes 40 located on the slanted surface 42 of the recess 44.

| | Average Water Collections, GPM/Ft$^2$ | |
|---|---|---|
| Measurement | Series 1 | Series 2 |
| 11.4 K-Factor Sprinkler Flowing 38 GPM | | |
| 16 - 0.5 m × 0.5 m Corner Pans | 0.025 | 0.043 |
| 4 - 0.15 m × 1 m Flue Space Pans | 0.053 | 0.060 |
| 14.5 K-Factor Sprinkler Flowing 60 GPM | | |
| 16 - 0.5 m × 0.5 m Corner Pans | 0.031 | 0.042 |
| 4 - 0.15 m × 1 m Flue Space Pans | 0.039 | 0.065 |

Note that in addition to providing a controlled increase in the amount of water added to the inner portion of the spray pattern, use of the four elongated holes 40 on the slanted surface 42 of the recess 44 within the central area 46 provides more uniform water collection results for the 11.4 and 14.5 K-factor ECOH pendent-type sprinklers of the invention.

Another purpose of the slanted surface 42 of the recess 44 within the central area 46 is to provide redistribution of the water spray and hence improvement in uniformity, as described in U.S. patent application Ser. No. 08/671,814, by Donald B. Pounder and Michael A. Fischer, filed Jun. 25, 1996, entitled *Deflector For Upright-Type Fire Sprinkler*, the disclosure of which is incorporated herein by reference.

A further feature of the deflector 22 of the invention involves minimizing overspray from an operating sprinkler towards adjacent sprinklers. In a typical sprinkler system installation, adjacent sprinklers are located in a grid pattern, with lines of sprinklers arranged parallel and perpendicular to each other. As a general case, experience has demonstrated that these directions are usually of primary concern for water spraying onto the thermally responsive elements 20 of adjacent sprinklers (i.e., cold soldering). This is of particular concern with ECOH sprinklers, which are designed to spray further outward than ordinary hazard classified standard coverage sprinklers.

In the described invention, minimizing the possibility of overspray from an operating sprinkler towards adjacent sprinklers perpendicular to the plane, $P_F$, of the frame arms is accomplished by providing irregularities on the adjacent inner surface 23 of the deflector 22 opposed to the sprinkler outlet 14, on each of the tines 32 in the plane, $P_P$, perpendicular to the plane, $P_F$, of the frame arms 28, 30. In the preferred embodiment, the irregularities have the form of a bump 50 (FIG. 3) extending upwards from each of the opposite tines 32 in the plane, $P_P$, perpendicular to the plane, $P_F$, of the frame arms 28, 30. The bumps 50 found to perform optimally in the preferred embodiment of this invention have an outside diameter, $D_B$, e.g. about 0.040 inch, and extend from the inner surface 23 of the deflector 22 opposed to the sprinkler outlet 14 by a height, $H_B$, e.g. about 0.025 inch. The bumps 50 function such that, at lower pressures (below 50 psi), the effect of the bumps 50 on the spray pattern is minimal. At these pressures, the water spray in the upper portion of the pattern does not have sufficient velocity to cause spray from the operating sprinkler to strike adjacent sprinklers spaced, e.g., about 9 ft. away. However, at higher pressures (e.g., greater than 50 psi), the water flowing radially along the surfaces of the deflector tines 32 has sufficient velocity to produce separation (break-off) at the bumps 50. This creates a slight V-shaped opening in the upper portion of the water spray pattern. By sizing the bumps 50 properly, the V-shaped opening can be made just wide enough to prevent wetting of adjacent sprinklers located in the directions of the plane, $P_P$, perpendicular to the plane, $P_F$, of the frame arms and as little as 9 ft. away, without any reducing effect on the area to be protected by the sprinkler 10.

ECOH type sprinklers tend to produce patterns in which much of the water is directed radially outward near the ceiling. This is necessary to provide effective spray coverage over the extended (larger) area. At higher pressures, e.g., greater than 50 psi, the effect of this discharge is to create a vacuum near the ceiling, which draws the air and combustion gases along the ceiling inward towards the sprinkler. This further tends to draw the pattern upward, thereby compounding the problem of possible overspray onto adjacent sprinklers. In general, the worst case situation is in the pressure range of about 80 psi to 120 psi. Thus the function of the bumps 50 of the invention can be very important at high pressures for reducing the potential for cold soldering.

It is noted that preferred embodiments of the deflector 22 of the invention has bumps 50 only on the tines 32 in the plane, $P_P$, perpendicular to plane, $P_F$, of the frame arms. In normal installations, the nearest adjacent sprinklers are located both in the plane, $P_P$, perpendicular to the plane, $P_F$ (on the nearest adjacent pipes), and in the plane, $P_F$ (on the same pipe as the flowing sprinkler). However, it has not generally been found necessary to have bumps 50 on the tines 32 in line with the plane, $P_F$, because the water flowing from the sprinkler outlet 14 over the frame arms 28, 30 tends to separate from the frame arms and, after striking the deflector 22, splashes upward in an arch-like manner often referred to as a "rooster tail". This water will typically strike either the ceiling (in the case of a recessed sprinkler mounted in the pendent position) or the pipe (in the case of an exposed sprinkler mounted in the pendent position) and then drip downward. This creates an opening in the spray pattern directly in line with the plane, $P_F$, such that, at high pressures, overspray onto the adjacent sprinklers typically does not occur in line with plane, $P_F$, of the frame arms 28, 30.

Another feature of the deflector 22 of the invention is four equally spaced openings 38 intersecting the periphery of the deflector at the angle, $A_S$, e.g. about 45° to the plane, $P_F$, of the frame arms 28, 30. The shape of the openings 38 is important to providing further control to optimize water distribution in these critical directions. In the preferred embodiment, the openings 38 have a specified base width, $W_{SB}$, near the root (innermost point) of the opening 38 and the width then gradually decreases in the radially outward direction, to a relatively smaller outer width, $W_{SO}$, at the periphery 52 of the deflector 22. Such a shape has been found to produce the desired density of water collection in areas near the sprinkler (at 45° relative to the plane, $P_F$), as well as in the area furthest from the sprinkler (at 45° relative to the plane, $P_F$), i.e., centered between four sprinklers. In the preferred embodiment of a deflector 22 for an 11.4 K-factor pendent-type sprinkler of the invention, the openings 38 have a base width, $W_{SB}$, of about 0.090 inch and an outer width, $W_{SO}$, of about 0.060 inch. In the preferred embodiment of a deflector 22 for an 14.5 K-factor pendent-type sprinkler of the invention, the openings 38 have a base width, $W_{SB}$, of about 0.100 inch and an outer width, $W_{SO}$, of about 0.083 inch.

According to one preferred embodiment of a 14.5 K-factor pendent-type sprinkler 10 of the invention, a deflector blank 24 has an outer diameter, $D_F$, e.g. about 1.600 inch, and a thickness, T, e.g. about 0.051 inch. The radial openings 34 form an included angle, $A_T$, e.g. about 16°40', equally spaced about centerlines $C_1$, $C_2$. The elongated holes 40 located on the slanted surface 42 within central area 46 are spaced from the axis, A, at a distance, $S_H$, e.g. about 0.255 inch. In the formed deflector 22, the spacing, $S_B$, between the centerlines of bumps 50 is, e.g., about 1.446 inch. The frusto-conically shaped recessed area 44 comprises a central area with a diameter, $D_C$, e.g. about 0.693 inch, and a base area, within the slanted surface portion 42, having a diameter, $D_A$, e.g. about 0.432 inch. The openings 38 are spaced from the axis, A, at a distance, $S_S$, e.g about 0.620 inch.

According to one preferred embodiment of an 11.4 K-factor pendent-type sprinkler 10 of the invention, a deflector blank 24 has an outer diameter, $D_F$, e.g. about 1.500 inch, and a thickness, T, e.g. about 0.051 inch. The radial openings 34 form an included angle, $A_T$, e.g. about 16°40', equally spaced about centerlines $C_1$, $C_2$. The elongated holes 40 are spaced from the axis, A, at a distance, $S_H$, e.g. about 0.255 inch. In the formed deflector 22, the spacing, $S_B$, between bumps 50 is, e.g., about 1.365 inch. The frusto-conically shaped recessed area 44 comprises a central area with a diameter, $D_C$, e.g. about 0.693 inch, and a base, within the slanted surface portion 42, having a diameter, $D_A$, e.g. about 0.432 inch. The openings 38 are spaced from the axis, A, at a distance, $S_S$, e.g about 0.500 inch.

In the case of a fire centered between four sprinklers, the thermally activated release of ECOH sprinklers can be somewhat slower, due, e.g., to the larger coverage areas, when compared to sprinklers installed in accordance with standard coverage spacing requirements. This means a fire may grow somewhat larger prior to sprinkler operation, and that the associated fire plume can generate greater upward velocities, which will tend to lift the spray pattern and reduce penetration of droplets onto burning surfaces. Thus if a deflector provides a predominantly outward pattern at the 45° location, the spray pattern may be uplifted to a point of reducing spray effectiveness. Consequently, it is necessary for the water distribution characteristics of an ECOH sprinkler to be well balanced, downward and outward, over the area to be protected.

It is noted that UL conducts a so-called 350 pound wood crib fire test with 7 ft., 6 in. (90 inches) clearance between the sprinkler deflector 22 and the top surface of the wood crib. In this test, an n-heptane fuel burner is located beneath the wood crib and provides a fire of approximately 2 megawatts which generates a strong upward plume. These tests are conducted with the sprinklers spaced in accordance with each coverage area for which the sprinkler is to be listed by UL. The performance of the ECOH pendent-type sprinklers of the present invention was exceptionally good in these test scenarios.

Other embodiments of the invention are within the following claims. For example, the slanted surface forming the center recess may be flat, or may have a slight bow or curve. Also, the essentially flat outer area surrounding the center recess and disposed generally perpendicular to the axis of the sprinkler outlet may include two or more tines bent upwards or downwards from the plane of the essentially flat area, without significant adverse effect on performance of the deflector of the invention. The irregularities formed on the inner surfaces of each of the opposite tines in the plane perpendicular to the plane of the frame arms may have a form other than the preferred form of a bump, the irregularity forming a notch-like opening in the upper part of the spray pattern to prevent cold soldering of adjacent sprinklers.

What is claimed is:

1. A pendent-type fire protection sprinkler comprising a body defining an orifice and outlet for flow of fluid from a source, and a deflector disposed generally coaxial with said outlet and positioned for impingement of the flow of fluid thereupon, said deflector defining an inner surface opposed to water flow from said outlet and an opposite outer surface, said inner surface defining:

a recess within a central area facing said sprinkler outlet, said recess comprising a slanted surface disposed at a predetermined acute angle to the horizontal, said slanted surface defining a plurality of through holes from said inner surface of said deflector to said opposite outer surface, and an essentially flat outer area surrounding said recess and disposed generally perpendicular to said axis of said sprinkler outlet, said recess being spaced further from said outlet relative to said essentially flat outer area.

2. The pendent-type fire protection sprinkler of claim 1 wherein said recess within said central area facing said sprinkler outlet has a frusto-conical shape.

3. The pendent-type fire protection sprinkler of claim 1 wherein said predetermined acute angle of said slanted surface is in the range of about 13° to 25°.

4. The pendent-type fire protection sprinkler of claim 3 wherein said predetermined acute angle of said slanted surface is in the range of about 16° to 22°.

5. The pendent-type fire protection sprinkler of claim 4 wherein said predetermined acute angle of said slanted surface is about 19°.

6. The pendent-type fire protection sprinkler of claim 1 wherein said plurality of through holes defined by said slanted surface comprises at least one through hole having an axis directed outwardly, away from said axis, in the direction of water flow from said outlet.

7. The pendent-type fire protection sprinkler of claim 1 wherein said plurality of through holes defined by said slanted surface comprises at least four through holes.

8. The pendent-type fire protection sprinkler of claim 7 wherein said plurality of through holes defined by said slanted surface comprises at least eight through holes.

9. The pendent-type fire protection sprinkler of claim 1, 6, 7 or 8 wherein said plurality of through holes defined by said slanted surface are generally equally spaced about said axis.

10. The pendent-type fire protection sprinkler of claim 1, 6, 7 or 8 wherein said plurality of through holes defined by said slanted surface has a first dimension, in a radial direction, and a second dimension, in a transverse direction, said first dimension being greater than said second dimension.

11. The pendent-type fire protection sprinkler of claim 10 wherein said first dimension is about 0.070 inch and said second dimension is about 0.050 inch.

12. The pendent-type fire protection sprinkler of claim 1 further comprising a pair of frame arms extending from said body and disposed generally in a first plane including said axis, with said deflector mounted thereupon, and said deflector further comprising a plurality of tines extending about its deflector periphery and defining a plurality of openings therebetween, a pair of opposite tines disposed in a second plane perpendicular to said first plane each comprising an irregularity constructed to create a notch-like opening in the upper part of the spray pattern to prevent cold soldering of adjacent sprinklers.

13. The pendent-type fire protection sprinkler of claim 12 wherein said irregularity comprises an upraised bump extending from said inner surface of said deflector towards said outlet.

14. The pendent-type fire protection sprinkler of claim 13 wherein each said bump has an outside diameter of about 0.040 inch and a height of about 0.025 inch.

15. The pendent-type fire protection sprinkler of claim 12, 13 or 14 wherein said plurality of openings comprises tapering openings disposed at about 45° to said first plane, said tapering openings having a first base width at an inner region and a second outer width at said deflector periphery, said first width being relatively greater than said second width, and said inner region being relatively closer to said axis than said deflector periphery, whereby the width of each of said tapering openings gradually decreases as the radial distance from said axis increases, out to said deflector periphery.

16. The pendent-type fire protection sprinkler of claim 15 wherein said first width dimension is in the range of about 0.080 inch to 0.110 inch and said second width dimension is in the range of about 0.050 inch to 0.090 inch.

17. The pendent-type fire protection sprinkler of claim 1 further comprising a pair of frame arms extending from said body and disposed generally in a first plane including said axis, with said deflector mounted thereupon, said deflector comprising a plurality of tines extending about its deflector periphery and defining a plurality of openings therebetween, said plurality of openings comprising tapering openings disposed at about 45° to said first plane, said tapering openings having a first base width at an inner region and a second outer width at said deflector periphery, said first width being relatively greater than said second width, and said inner region being relatively closer to said axis than said deflector periphery, whereby the width of each of said tapering openings gradually decreases as the radial distance from said axis increases, out to said deflector periphery.

18. The pendent-type fire protection sprinkler of claim 17 wherein said first width dimension is in the range of about 0.080 inch to 0.110 inch and said second width dimension is in the range of about 0.050 inch to 0.090 inch.

19. A pendent-type fire protection sprinkler comprising:

a body defining an orifice and outlet for flow of fluid from a source, a deflector disposed generally coaxial with said outlet and positioned for impingement of the flow of fluid thereupon, said deflector defining an inner surface opposed to water flow from said outlet and an opposite outer surface, and a pair of frame arms extending from said body and disposed generally in a first plane including said axis, with said deflector mounted thereupon, said deflector comprising a plurality of tines extending about its deflector periphery and defining a plurality of openings therebetween, a pair of opposite tines disposed in a second plane perpendicular to said first plane each defining an irregularity constructed to create a notch-like opening in the upper part of the spray pattern to prevent cold soldering of adjacent sprinklers.

20. The pendent-type fire protection sprinkler of claim 19 wherein said irregularity comprises an upraised bump extending from said inner surface of said deflector towards said outlet.

21. The pendent-type fire protection sprinkler of claim 20 wherein each said bump has an outside diameter of about 0.040 inch and a height of about 0.025 inch.

22. The pendent-type fire protection sprinkler of claim 20 wherein said inner surface of said deflector defines a recess within a central area facing said sprinkler outlet, said recess comprising a slanted surface disposed at a predetermined acute angle to the horizontal, said slanted surface defining a plurality of through holes from said inner surface of said deflector to said opposite outer surface, and an outer area surrounding said recess, said recess being spaced further from said outlet relative to said outer area.

23. The pendent-type fire protection sprinkler of claim 22 wherein said outer area is essentially flat and disposed generally perpendicular to said axis of said sprinkler outlet.

24. The pendent-type fire protection sprinkler of claim 22 or 23 wherein said recess within said central area facing said sprinkler outlet has a frusto-conical shape.

25. A pendent-type fire protection sprinkler comprising:

a body defining an orifice and outlet for flow of fluid from a source, a deflector disposed generally coaxial with said outlet and positioned for impingement of the flow of fluid thereupon, said deflector defining an inner surface opposed to water flow from said outlet and an opposite outer surface, and a pair of frame arms extending from said body and disposed generally in a first plane including said axis, with said deflector mounted thereupon, said deflector comprising a plurality of tines extending about its deflector periphery and defining a plurality of openings therebetween, said plurality of openings comprising tapering openings disposed at about 45° to said first plane, said tapering openings having a first base width at an inner region and a second outer width at said deflector periphery, said first width being relatively greater than said second width, and said inner region being relatively closer to said axis than said deflector periphery, the width of each of said tapering openings gradually decreasing with increasing radial distance from said axis out to said deflector periphery.

26. The pendent-type fire protection sprinkler of claim 25 wherein said first width dimension is in the range of about 0.080 inch to 0.110 inch and said second width dimension is in the range of about 0.050 inch to 0.090 inch.

27. The pendent-type fire protection sprinkler of claim 25 or 26 wherein a pair of said tines disposed in opposite positions in a second plane perpendicular to said first plane each defines an irregularity constructed to create a notch-like opening in the upper part of the spray pattern to prevent cold soldering of adjacent sprinklers.

28. The pendent-type fire protection sprinkler of claim 27 wherein said irregularity comprises an upraised bump extending from said inner surface of said deflector towards said outlet.

29. The pendent-type fire protection sprinkler of claim 28 wherein each said bump has an outside diameter of about 0.040 inch and a height of about 0.025 inch.

30. The pendent-type fire protection sprinkler of claim 25 wherein said inner surface of said deflector defines a recess within a central area facing said sprinkler outlet, said recess comprising a slanted surface disposed at a predetermined acute angle to the horizontal, said slanted surface defining a plurality of through holes from said inner surface of said deflector to said opposite outer surface, and an outer area surrounding said recess, said recess being spaced further from said outlet relative to said outer area.

31. The pendent-type fire protection sprinkler of claim 25 wherein said outer area is essentially flat and disposed generally perpendicular to said axis of said sprinkler outlet.

32. The pendent-type fire protection sprinkler of claim 1, 19 or 25, wherein said sprinkler has a K-factor of at least 5.0.

33. The pendent-type fire protection sprinkler of claim 32, wherein said sprinkler has a K-factor of at least 7.0.

34. The pendent-type fire protection sprinkler of claim 33, wherein said sprinkler has a K-factor of at least 10.5.

35. The pendent-type fire protection sprinkler of claim 34, wherein said sprinkler has a K-factor of at least 13.0.

36. The pendent-type fire protection sprinkler of claim 30 wherein said outer area is essentially flat and disposed generally perpendicular to said axis of said sprinkler outlet.

37. The pendent-type fire protection sprinkler of claim 30 or 36 wherein said recess within said central area facing said sprinkler outlet has a frusto-conical shape.

* * * * *